US006610932B2

(12) United States Patent
Van Den Berg et al.

(10) Patent No.: US 6,610,932 B2
(45) Date of Patent: Aug. 26, 2003

(54) CABLE AND METHOD FOR PRECLUDING FLUID WICKING

(75) Inventors: David C. Van Den Berg, Markleeville, CA (US); Thomas Eldridge, Portville, NY (US); Robert Scott Evans, Austin, TX (US)

(73) Assignee: Bently Neveda, LLC, Minden, NV (US)

( * ) Notice: Subject to any disclaimer, the term of this patent is extended or adjusted under 35 U.S.C. 154(b) by 0 days.

(21) Appl. No.: 09/927,733

(22) Filed: Aug. 10, 2001

(65) Prior Publication Data

US 2002/0027008 A1 Mar. 7, 2002

Related U.S. Application Data

(62) Division of application No. 09/260,234, filed on Mar. 1, 1999, now Pat. No. 6,293,005.

(51) Int. Cl.[7] ..... H01B 7/00; H01B 11/06
(52) U.S. Cl. ..... 174/120 R; 174/36
(58) Field of Search ..... 174/110 R, 120 R, 174/21 R, 23 R, 36, 23 C, 25 R, 28, 121 A; 156/48, 885, 74, 86, 87

(56) References Cited

U.S. PATENT DOCUMENTS

| | | | |
|---|---|---|---|
| 252,249 | A | 1/1882 | Philips |
| 1,769,524 | A | 7/1930 | Mample |
| 2,782,248 | A | 2/1957 | Clark |
| 3,180,926 | A | 4/1965 | Trill |
| 3,290,194 | A | 12/1966 | Gillemot |
| 3,532,575 | A | 10/1970 | Nagata et al. |
| 3,639,201 | A | 2/1972 | Humphries |
| 3,639,674 | A | 2/1972 | Stier |
| 3,643,007 | A | 2/1972 | Roberts et al. |
| 3,739,073 | A | 6/1973 | Schneider et al. |
| 3,743,748 | A | 7/1973 | Reeder |
| 3,748,372 | A | 7/1973 | McMahon et al. |
| 3,789,099 | A | 1/1974 | Garrett et al. |
| 3,795,224 | A | 3/1974 | Batson et al. |
| 3,836,695 | A | 9/1974 | Strecker et al. |
| 3,860,824 | A | 1/1975 | Stone |
| 3,885,380 | A | 5/1975 | Hacker |
| 3,917,900 | A | 11/1975 | Arnaudin, Jr. |
| 3,948,102 | A | 4/1976 | Coon |
| 3,982,060 | A | 9/1976 | Avery et al. |
| 4,177,097 | A | 12/1979 | Hudson, Jr. et al. |

(List continued on next page.)

FOREIGN PATENT DOCUMENTS

| | | | | |
|---|---|---|---|---|
| IT | DT 2906-735 A | | 8/1979 | |
| WO | WO 96/25782 | | 8/1996 | |
| WO | WO 96/25782 A | * | 8/1996 | ..... H02G/15/20 |

*Primary Examiner*—William H Mayo, III
(74) *Attorney, Agent, or Firm*—Dennis A. DeBoo

(57) ABSTRACT

A method and a resulting communication cable is disclosed which provides multiple degrees of control of fluid wicking propensity within the interior of the cable by impregnating the cable with a sealing composition and curing the sealing composition therein. The cable includes a central strata, a penultimate strata and an ultimate strata concentrically disposed. The central strata includes a central signal transmission medium circumscribed by a dielectric having an etched exterior surface. The penultimate strata includes a braided conductor circumscribing the dielectric and an inner jacket surrounding the braided conductor and including an etched exterior surface. The penultimate strata further includes at least one non-continuous zone of sealing composition impregnated into the braided conductor and bonding with the etched exterior surface of the dielectric. The ultimate strata includes a braided sheath circumscribing the inner jacket and an outer jacket surrounding the braided sheath. The ultimate strata further includes an extended substantially continuous zone of sealing composition impregnated into the braided sheath and bonding with the etched exterior surface of the inner jacket.

20 Claims, 5 Drawing Sheets

U.S. PATENT DOCUMENTS

| | | | | | |
|---|---|---|---|---|---|
| 4,227,043 | A | | 10/1980 | Stohr et al. | |
| 4,273,829 | A | | 6/1981 | Perreault | |
| 4,317,002 | A | | 2/1982 | Spicer | |
| 4,339,733 | A | | 7/1982 | Smith | |
| 4,376,920 | A | | 3/1983 | Smith | |
| 4,385,203 | A | | 5/1983 | Faranetta et al. | |
| 4,408,089 | A | | 10/1983 | Nixon | |
| 4,486,252 | A | | 12/1984 | Lloyd | |
| 4,599,487 | A | | 7/1986 | Blank et al. | |
| 4,641,110 | A | | 2/1987 | Smith | |
| 4,673,231 | A | | 6/1987 | McAnulty, Sr. | |
| 4,675,470 | A | | 6/1987 | Hata et al. | |
| 4,727,262 | A | | 2/1988 | O'Loughlin | |
| 4,733,464 | A | | 3/1988 | Gregorac | |
| 4,746,281 | A | | 5/1988 | Laugs et al. | |
| 4,801,803 | A | | 1/1989 | Denen et al. | |
| 4,845,309 | A | | 7/1989 | Vincent et al. | |
| 4,918,260 | A | | 4/1990 | Griffith et al. | |
| 4,998,004 | A | | 3/1991 | Lawrence et al. | |
| 5,000,539 | A | | 3/1991 | Gareis | |
| 5,041,950 | A | | 8/1991 | Tyson | |
| 5,043,530 | A | * | 8/1991 | Davies | 174/102 R |
| 5,072,073 | A | | 12/1991 | Becker et al. | |
| 5,150,442 | A | | 9/1992 | Desmons | |
| 5,151,143 | A | | 9/1992 | Downie | |
| 5,194,692 | A | | 3/1993 | Gallusser et al. | |
| 5,295,120 | A | | 3/1994 | McShane | |
| 5,457,288 | A | | 10/1995 | Olsson | |
| 5,475,219 | A | | 12/1995 | Olson | |
| 5,519,172 | A | * | 5/1996 | Spencer et al. | 174/110 F |
| 5,539,323 | A | | 7/1996 | Davis, Jr. | |
| 5,729,150 | A | | 3/1998 | Schwindt | |
| 5,770,941 | A | * | 6/1998 | Van Den Berg | 174/52.2 |
| 5,841,737 | A | | 11/1998 | Schaefer | |
| 5,856,645 | A | | 1/1999 | Norton | |
| 5,876,528 | A | | 3/1999 | Nikkels et al. | |
| 5,903,306 | A | | 5/1999 | Heckendorn et al. | |

* cited by examiner

CABLE AND METHOD FOR PRECLUDING FLUID WICKING

CROSS REFERENCE TO RELATED APPLICATION

This is a division of application Ser. No. 09/260,234, filed Mar. 1, 1999, and issued on Sep. 25, 2001, as U.S. Pat. No. 6,293,005

FIELD OF THE INVENTION

The instant invention relates generally to precluding fluid wicking within an interior of a cable and, in particular, to precluding fluid wicking within an interior of a cable connected at one end to a sensor strategically deployed on assets including machinery to be monitored and operatively coupled at an opposing end to a processing unit.

BACKGROUND OF THE INVENTION

A wide variety of applications in the industry of monitoring plant assets including machinery require an internal mounting arrangement of at least one transducer or sensor. For example, a mounting bracket may be used to strategically mount the transducer within a machine case and route a cable associated with the transducer out of the machine case. The routing of the cable through the machine case is usually through an adapter which includes some type of rubber grommet. The rubber grommet functions as, inter alia, a means for preventing fluid leakage through the case via an outer surface of the cable.

A junction box is typically mounted on or near the exterior of the machine case and encloses the electrical connections between the transducer cable and an extension cable that is used to route the output of the transducer to a processing unit.

As noted, the rubber grommet adequately prevents fluid from exiting through the machine case via the outer surface of the cable.

However, a long felt problem in the industry still exists in that the fluid permeates through cuts and cracks in an outer jacket of the cable and is wicked up by the interior and particularly the underlying braiding of the cable and is thus allowed to flow into the junction box and/or onto a plant floor. This not only causes a safety hazard, but an environmental hazard as well. Consequently, the junction box must be periodically drained of fluid and/or the plant floor cleaned.

Furthermore, fluid may penetrate to the interior of the cable by way of a transition area between the transducer and one end of the cable. Moreover, the transducer itself may become damaged and allow fluid ingression to be wicked up by the braiding of the cable such that fluid is drawn from within the interior of the machine case to an outside environment.

A need therefore exists for providing a cable which precludes fluid wicking within the interior of the cable such that the fluid is not drawn from within an interior of an asset including machinery being monitored to an outside environment. In addition, there is a need for a cable which precludes fluid wicking while remaining flexible so that it can be easily routed through machinery and conduit. Furthermore, there is a need for a cable which precludes fluid wicking while retaining its original ability to be readily electrically connectable to a transducer or sensor on at least one end.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 252,249 | Jan. 10, 1882 | Philips |
| 1,769,524 | Jul. 1, 1930 | Maple |
| 2,782,248 | Feb. 19, 1957 | Clark |
| 3,180,926 | Apr. 27, 1965 | Trill |
| 3,532,575 | Oct. 6, 1970 | Nagata, et al. |
| 3,639,201 | Feb. 1, 1972 | Humphries |
| 3,739,073 | Jun. 12, 1973 | Schneider, et al. |
| 3,789,099 | Jan. 29, 1974 | Garrett, et al. |
| 3,836,695 | Sep. 17, 1974 | Strecker, et al. |
| 3,885,380 | May 27, 1975 | Hacker |
| 4,177,097 | Dec. 4, 1979 | Hudson, Jr., et al. |
| 4,227,043 | Oct. 7, 1980 | Stöhr, et al. |
| 4,317,002 | Feb. 23, 1982 | Spicer |
| 4,385,203 | May 24, 1983 | Faranetta, et al. |
| 4,599,487 | Jul. 8, 1986 | Blank, et al. |
| 4,746,281 | May 24, 1988 | Laugs, et al. |
| 4,845,309 | Jul. 4, 1989 | Vincent, et al. |
| 5,041,950 | Aug. 20, 1991 | Tyson |
| 5,072,073 | Dec. 10, 1991 | Becker, et al. |
| 5,151,143 | Sep. 29, 1992 | Downie |

SUMMARY OF THE INVENTION

The instant invention is distinguished over the known prior art in a multiplicity of ways. For one thing, the instant invention provides a communication cable which includes multiple degrees of control of fluid wicking propensity within an interior of the cable such that fluid is prevented from being drawn from within an interior of an asset such as a machine being monitored to an outside environment. In addition, the instant invention provides a communication cable for precluding fluid wicking which substantially retains its original flexibility after being impregnated with a sealing composition thereby allowing the communication cable of the instant invention to make sharp angle bends and be easily routed through machinery and conduit. Furthermore, the instant invention provides a communication cable which is impregnated with a sealing composition such that it retains its original ability to be readily electrically connectable to a transducer or sensor on at least one end.

In one embodiment of the instant invention, the communication cable is in a form of a triaxial cable. The triaxial cable includes a central strata, a penultimate strata and an ultimate strata concentrically disposed. The central strata includes a central signal transmission medium separated from the penultimate strata by a central insulator or dielectric. The penultimate strata includes a braided conductor circumscribing the dielectric and an inner jacket surrounding the braided conductor thereby forming a coaxial assembly. The ultimate strata includes a braided sheath surrounding the inner jacket and an outer jacket circumscribing the braided sheath thereby forming the triaxial cable.

The penultimate strata further includes at least one axially and radially extending zone of sealing composition or sealant which is disposed within the braided conductor and bonded to an etched exterior surface of the central dielectric. The sealant also bonds to an interior surface of the inner jacket. The ultimate strata includes axially and radially extending zone of sealing composition disposed within the braided sheath and bonded to an etched exterior surface of the inner jacket.

In one embodiment, the communication cable may be manufactured in the form of the triaxial cable which is multiple meters in length. The manufacturing process may include the step of providing the central signal transmission medium or a central conductor which longitudinally extends from a first end to a second end and covering or extruding the dielectric over the central conductor. Next, the exterior surface of the dielectric is etched, by preferable running it through a chemical liquid etching bath.

The next step is to draw or wrap the braided conductor over the etched exterior surface of the dielectric wherein the braided conductor is formed from a plurality of braided wire strands including interstices defined by spaces interposed between the wire strands forming the braided conductor.

The next step is to form a plurality of zones of sealing composition intermittently disposed along the axial length of the braided conductor. The zones are formed by intermittently extruding sealing composition through a die and under pressure for forcing the uncured sealing composition through the braided wire strands and into contact with the exterior surface of the dielectric wherein the sealing composition bonds therewith for filling in areas of tangency between the dielectric and the braided conductor at spaced apart intervals. In addition, the intermittently extruded sealing composition covers an exterior of the braided conductor and fills in the interstices defined by the spaces interposed between the wire strands of the braided conductor at spaced apart intervals. Thus, the communication cable is preferably formed to include a plurality of axial lengths of braided conductor which are substantially void of sealing composition and a plurality axial lengths of the braided conductor which are ensconced with the sealing composition. Thus, the step of alternating between an axial length of the braided conductor which is ensconced with sealing composition with an axial length which is substantially void of sealing composition solves the problem of having to remove the sealing composition from the braided conductor every time a length of cable is prepared for attachment to a transducer or sensor.

The next step is to extrude the inner jacket over the braided conductor immediately after the sealing composition is extruded over the braided conductor wherein the sealing composition is still in a substantially uncured state so that the sealing material will bond with the interior surface of the inner jacket. After the inner jacket has been extruded over the braided conductor the cable may be partially or fully cured. The central and penultimate strata form the coaxial assembly.

Once the coaxial assembly has been formed the essence of the above-process is repeated. Specifically, the exterior surface of the inner jacket is etched, by preferable running it through a chemical liquid etching bath, the braided sheath is then drawn or wound over the exterior surface of the inner jacket and is formed from a plurality of braided wire strands including interstices defined by spaces interposed between the wire strands forming the braided sheath.

Next, the cable is drawn through a die where a sealing material is extruded under pressure over and through the braided sheath and into contact with the inner jacket thereby completely filling in the interstices of the braided sheath substantially along its entire axial length and essentially making the braided sheath voidless. The sealing composition chemically bonds to the etched exterior surface of the inner jacket for forming a seal impervious to fluid wicking therebetween. As a final step the outer jacket is extruded over the triax braid thereby forming the triaxial assembly.

In an alternative embodiment of the instant invention, the communication cable is in a form of a coaxial cable. The coaxial cable includes a central strata, a penultimate strata and an ultimate strata concentrically disposed. The central strata includes a central signal transmission medium separated from the penultimate strata by a central insulator or dielectric. The penultimate strata includes a braided conductor circumscribing the dielectric. The ultimate strata includes an outer jacket circumscribing the braided conductor thereby forming the coaxial cable.

In the alternate embodiment, the communication cable is preferably manufactured in the form of the coaxial cable which is multiple meters in length. The manufacturing process may include the step of providing the central signal transmission medium or a central conductor which longitudinally extends from a first end to a second end and covering or extruding the dielectric over the central conductor. Next, the exterior surface of the dielectric is etched, by preferably running it through a chemical liquid etching bath.

The next step is to draw or wrap the braided conductor over the etched exterior surface of the dielectric wherein the braided conductor is formed from a plurality of braided wire strands including interstices defined by spaces interposed between the wire strands for forming the braided conductor. Next, the cable is drawn through a die where the sealing composition is extruded under pressure over and through the braided conductor and into contact with the etched dielectric thereby completely filling in the interstices of the braided conductor substantially along its entire axial length and essentially making the braided conductor voidless. The sealing composition chemically bonds to the etched exterior surface of the dielectric for forming a seal impervious to fluid wicking therebetween.

As a final step, the outer jacket is extruded over the braided conductor immediately after the sealing composition is extruded over the braided conductor wherein the sealing composition is still in a substantially uncured state so that the sealing composition will bond with the interior surface of the outer jacket. Alternatively, the sealing composition maybe partially or fully cured prior to the jacket being extruded over the braided conductor.

SUMMARY OF THE INVENTION

Accordingly, it is an object of the instant invention to provide a new and novel cable and method for precluding fluid wicking within an interior of the cable.

Another further object of the instant invention is to provide a cable as characterized above which is impregnated along an axial length of a braided conductor and substantially continuously impregnated along an axial length of a braided sheath circumscribing said braided conductor.

Another further object of the instant invention is to provide a cable as characterized above which substantially retains its original flexibility.

Another further object of the of the instant invention is to provide a cable as characterized above which retains its original ability to be electrically connected to a sensor.

Another further object of the instant invention is to provide a cable as characterized above which can be mass-produced as one continuously long length of cable which includes a braided conductor which is intermittently impregnated with a sealing composition along an axial length of the braided conductor and which when cut to an individual desired length includes a first axial length of the braided conductor which is ensconced with sealant and a second axial length adjacent the first axial length which is void of sealant such that the braided conductor retains its original electrical connectivity along the second axial length.

Viewed from a first vantage point, it is an object of the instant invention to provide a communication cable, comprising in combination, a first end and a second end, a conductor communicating the first end with the second end, a dielectric insulator circumscribing the conductor and including an exterior surface, a braided conductor circumscribing the insulator, the braided conductor formed from a plurality of braided strands having interstices therebetween, an axially extending zone of sealing composition impregnated into the braided conductor and filling the interstices along a first axial length of the braided conductor, interstices residing on at least one side of the axially extending zone being substantially void of sealant along a greater axial length then the first axial length of filled interstices.

Viewed from a second vantage point, it is an object of the instant invention to provide a communication cable, comprising in combination, a central strata, a penultimate strata circumscribing the central strata, an ultimate strata circumscribing the penultimate strata, a first zone of sealing composition impregnated within the penultimate strata and extending along a first axial length of the penultimate strata for abating fluid progression via fluid wicking within the penultimate strata, a second zone of sealing composition radially spaced from the first zone and impregnated within the ultimate strata for precluding fluid wicking within the ultimate strata, the second zone of sealing composition extending along a second axial length greater than the first axial length of the first zone of sealing composition.

Viewed from a third vantage point, it is an object of the instant invention to provide a process for making a communication cable for precluding fluid wicking, the steps including, utilizing a center conductor, circumscribing the center conductor with a dielectric, etching an exterior surface of the dielectric, circumscribing the dielectric with a braided conductor comprised of a plurality of braided strands having interstices therebetween, impregnating the braided conductor with a liquid sealing composition for forming an axially extending zone of sealing composition ensconcing and filling in an axial length of the interstices and radially extending to an area of tangency between the braided conductor and the etched exterior surface of the dielectric for bonding thereto, extruding an imperforate inner jacket over the braided conductor and the axially extending zone of sealing composition while both the axially extending zone of sealing composition and the inner jacket are both in a fluidic state for enhancing the bonding between an interior surface of the inner jacket and the radially and axially extending zone of sealing composition for filling in an axially extending area of tangency between the braided conductor and the axially imperforate inner jacket, curing the cable wherein the axially extending zone of sealing composition precludes fluid wicking along the braided conductor.

Viewed from a fourth vantage point, it is an object of the instant invention to provide a method for monitoring status of a shaft in a casing which requires a communication cable passing through the casing and preventing fluid from escaping from the casing through the cable by wicking and capillary attraction, the steps including, impregnating the cable with an uncured sealing composition, leaving the sealing composition off an interior axial length of the cable thereby providing at least one axially extending area void of sealing composition and at least one axially extending area impregnated with sealing composition, curing the sealing composition in the cable such that the cable abates fluid wicking and capillary attraction, connecting the axially extending area void of sealing composition to a transducer, positioning the transducer adjacent the shaft, and routing the cured, sealed cable through the casing to a data receiving unit.

Viewed from a fifth vantage point, it is an object of the instant invention to provide a method for monitoring status of a shaft in a casing which requires a communication cable passing through the casing and preventing fluid from escaping from the casing through the cable by wicking and capillary attraction, the steps including, forming the cable with sealing composition impervious to fluid and fluid vapor transmission, exposing cable conductors along an axial length of the cable, connecting the exposed end of the cable to a transducer, positioning the transducer adjacent the shaft, and routing the substantially uniformly cured cable through the casing to a data receiving unit wherein said sealing composition precludes fluid and fluid vapor from escaping from the casing.

Viewed from a sixth vantage point, it is an object of the instant invention to provide a communication cable, comprising in combination, a central strata and a penultimate strata concentrically disposed, a longitudinally non-continuous band of sealing composition interposed between the concentrically disposed strata for filling in interstices therebetween thereby abating fluid wicking propensity between the central strata and the penultimate strata.

Viewed from a sixth vantage point, it is an object of the instant invention to provide a communication cable, comprising in combination: a dielectric circumscribing a central conductor; a braided conductor circumscribing the dielectric; an imperforate jacket circumscribing the braided conductor; a longitudinally continuous band of sealing composition interposed between the dielectric and the imperforate jacket for filing in interstices therebetween wherein the sealing composition precludes fluid wicking along the braided conductor and leakage at areas of tangency between the braided conductor and both the dielectric and imperforate jacket.

These and other objects will be made manifest when considering the following detailed specification when taken in conjunction with the appended drawing figures.

DESCRIPTION OF PREFERRED EMBODIMENTS

Figure 1:
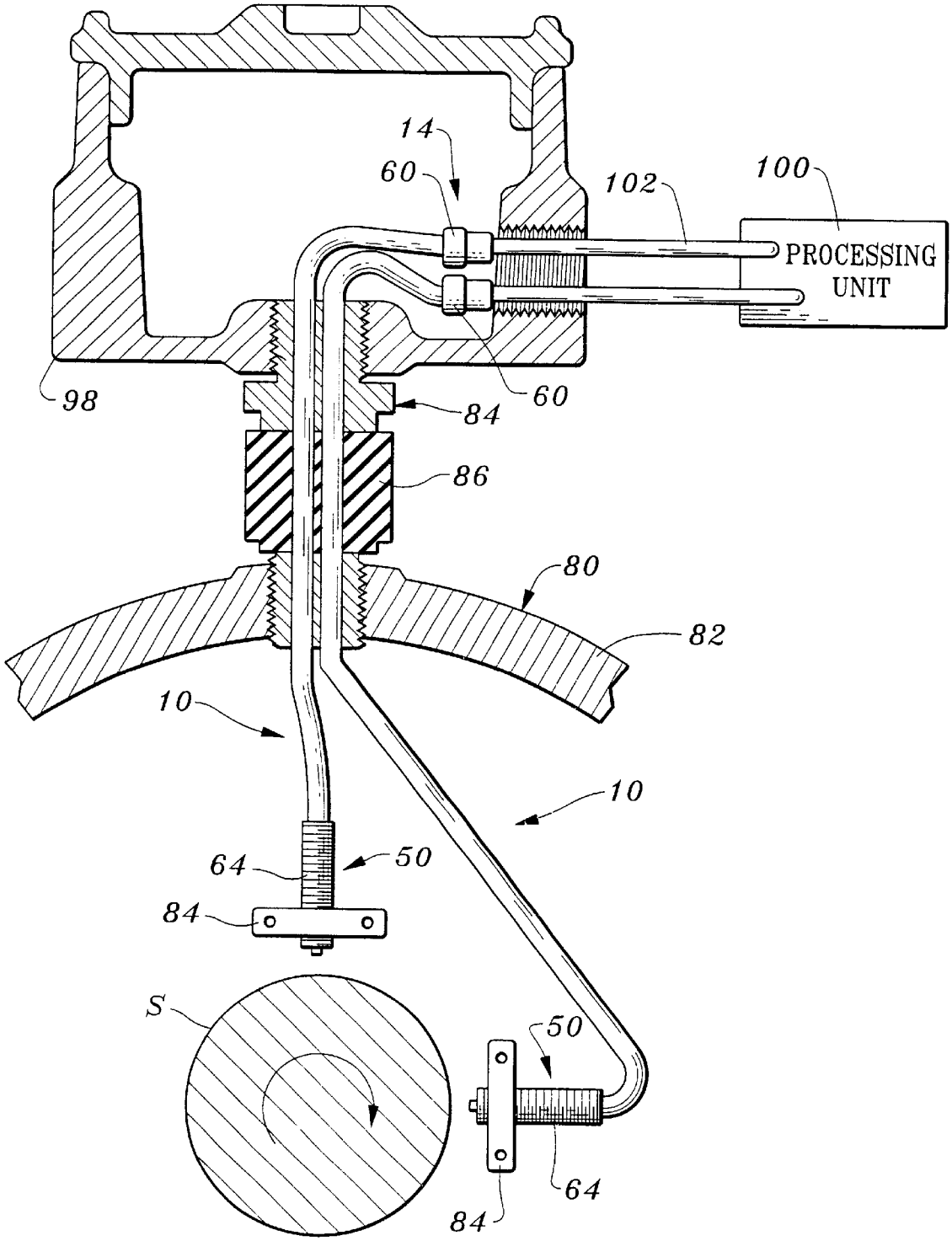
FIG. 1 is an elevational view of a cable according to the instant invention shown routed through a machine case of a machine for communicating parameters of the machine from a transducer electrically connected to the cable at one end to a processing unit operatively coupled to an opposing end.

Considering the drawings, wherein like reference numerals denote like parts throughout the various drawing figures, reference numeral 10 is directed to the communication cable according to the instant invention.

Figure 2:
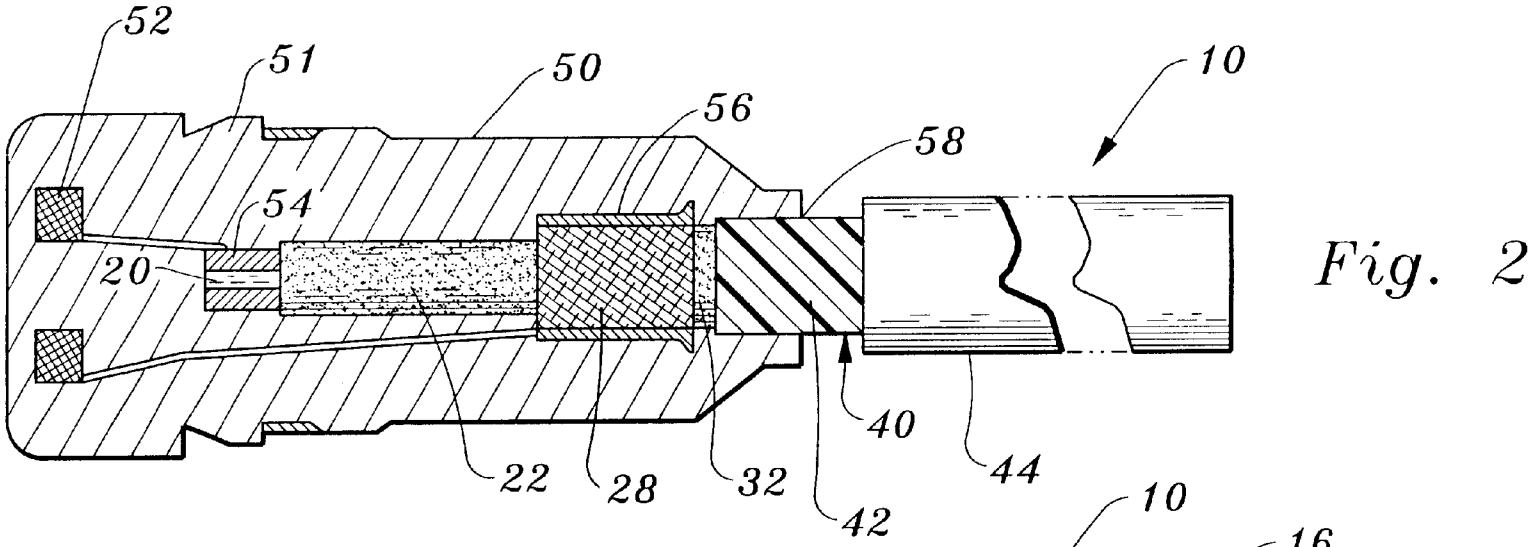
FIG. 2 is a simplified cross-sectional view of the transducer shown in FIG. 1 electrically coupled to an end of the cable which has been stripped in a step-like fashion.
Figure 3:
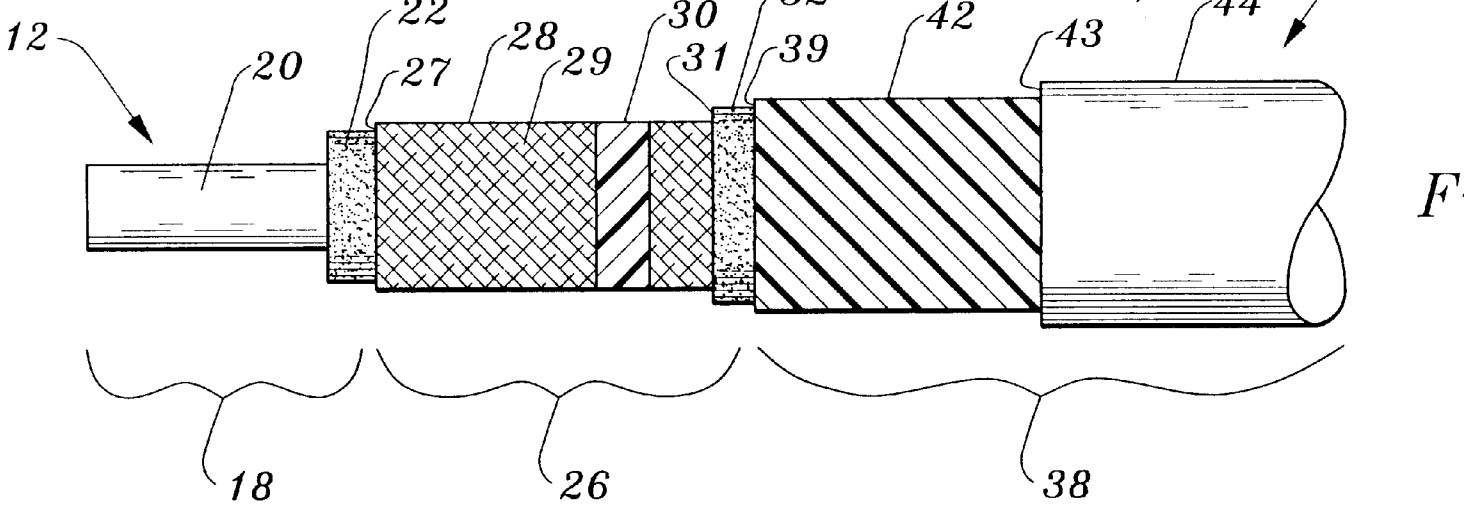
FIG. 3 is a prospective view of a length of the cable which has been stripped in a step-like fashion to reveal underlying strata.

In its essence, and referring to FIGS. 1 through 3, a communication cable 10 is provided which includes multiple degrees of control of fluid wicking propensity between for example, a transducer 50 strategically placed in areas of machinery 80 for monitoring the status thereof and a processing unit 100 which receives the signals engendered from the transducer 50. The communication cable 10 is comprised of a first end 12, a second end 14 and an intermediate portion 16 communicating the first end 12 with the second end 14. The intermediate portion 16 preferably includes a central strata 18, a penultimate strata 26 and an ultimate strata 38 concentrically disposed. In addition, the communication cable 10 includes a plurality of radially spaced zones 30, 42 of sealing composition which are interposed between the concentric strata for filling in interstices defined by spaces within and between the concentric strata for providing the multiple degrees of control of fluid wicking propensity within the interior of the cable.

Figure 4:
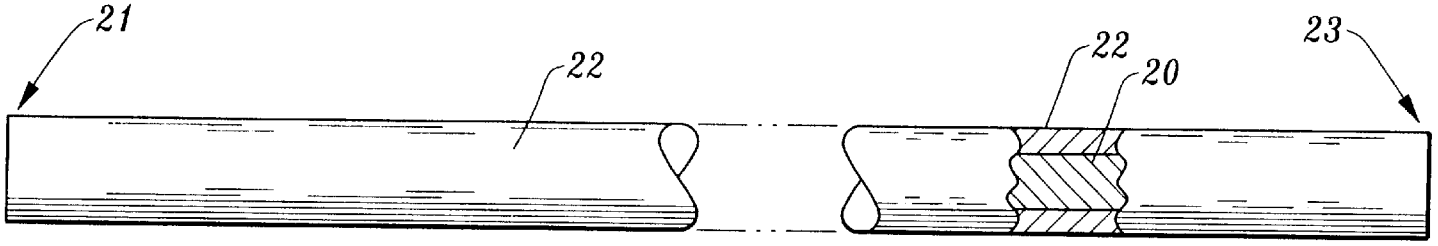
FIG. 4 is a perspective view of a dielectric of the cable including a partial cross-sectional view showing the dielectric circumscribing a central conductor of the cable.

More particularly, and referring to FIGS. 3 and 4, the central strata 18 includes a central signal transmission medium 20 circumscribed by a central insulator or dielectric 22. The central signal transmission medium 20 includes at least one conductor or may include a plurality of conductors each of which maybe stranded wire conductor, a solid conductor or a combination of the two. Preferably, the central signal transmission medium 20 is formed from a plurality of concentrically stranded high strength, high conductivity silver coated copper alloy wires. The dielectric 22 is preferable formed from a solid, extruded polytetrafluoroethylene (PTFE) type material.

Figure 5:
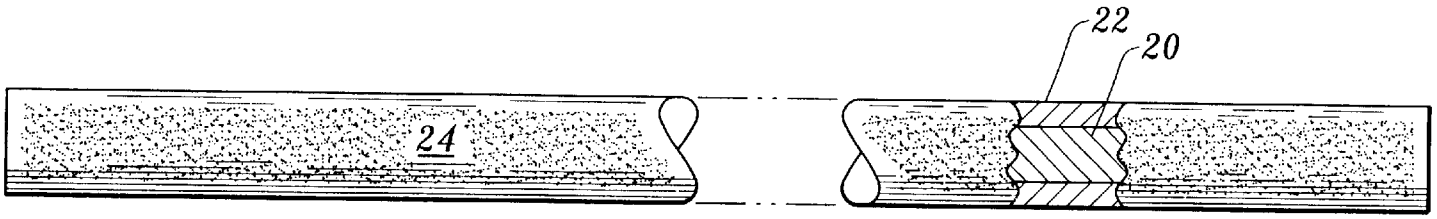
FIG. 5 is a perspective view of the dielectric shown in FIG. 4 after being etched and including a partial cross-sectional view showing the dielectric circumscribing the center conductor of the cable.

Referring to FIG. 5, the extruded PTFE dielectric 22 includes an exterior surface which is preferably chemically etched with, for example, sodium naphthalene for providing an etched exterior surface 24 defining a bonding surface of the dielectric 22.

Figure 6:
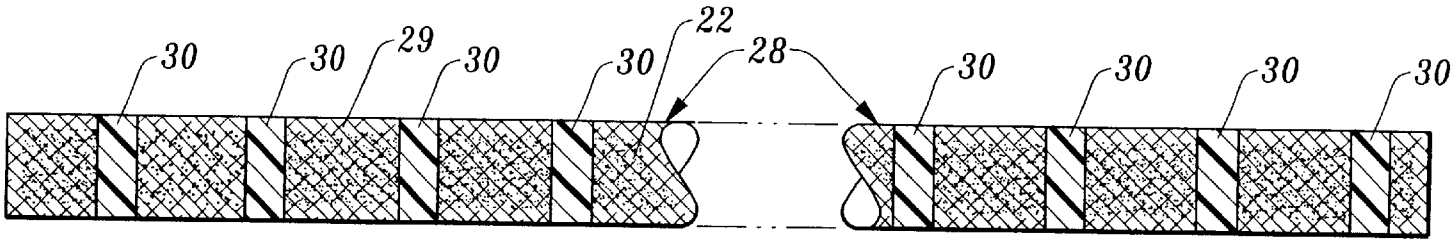
FIG. 6 is a perspective view of a braided conductor circumscribing the etched dielectric shown in FIG. 5 and including a plurality of intermittently disposed zones of sealing composition.

Referring to FIGS. 3 and 6, the penultimate strata 26 circumscribes the dielectric 22 and includes a least one conductor 28 circumscribed by a inner jacket 32. The conductor 28 may be a flexible solid conductor, a stranded conductor or a combination of these two types of conductors. Preferably, the conductor 28 is a stranded conductor and particularly a wire braided conductor or a coax braid 28. The wire braided conductor 28 may, for example, be made from one of a class of materials characterized as having excellent conductivity, such as copper or copper clad steel with silver flash. The wire braided conductor 28 usually provides a ground connection which communicates the first end 12 with the second end 14. In addition, the wire braided conductor 28 may be effective as a shield which reduces the pickup of interference signals by the central signal transmission medium 20. Furthermore, at high frequencies, the central signal transmission medium 20 may radiate too much energy away from the medium 20 for a strong enough signal to be transmitted by the medium 20. The wire braided conductor 28 substantially eliminates this problem.

The wire braided conductor 28 is formed from a plurality of braided wire strands including interstices defined by spaces 29 interposed between the wire strands forming the braided conductor 28. In addition, a plurality of interstices are formed at the areas of tangency 27 between the wire braided conductor 28 and the etched dielectric 22.

Referring to FIGS. 3 and 6, at least one axially and radially extending zone 30 of sealing composition is impregnated into the braided conductor 28 for filling in interstices along an axial length of the braided conductor 28. The zone 30 of sealing composition radially extends to and bonds with the etched exterior surface 24 of the dielectric 22 for filling in the interstices along at least one axially extending area of tangency 27 between the dielectric 22 and the braided conductor 28. Preferably, the interstices residing on at least one side of the axially extending zone 30 of sealing composition is substantially void of the sealing composition along a greater axial length than the axial length of zone 30.

Figure 7:
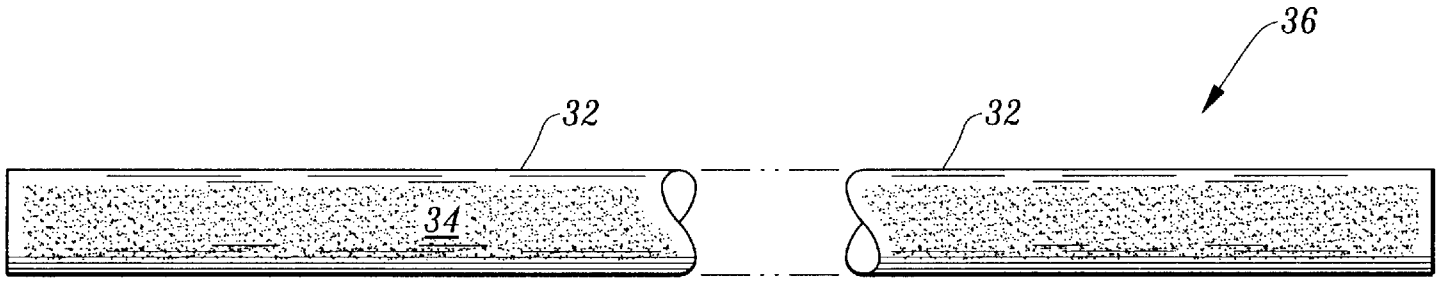
FIG. 7 is a perspective view of an inner jacket circumscribing that which is shown in FIG. 6 and including an etched exterior surface.

Referring to FIGS. 3 and 7, the inner jacket 32 circumscribes the braided conductor 28 thereby forming a coaxial assembly 36. A plurality of interstices are formed at the areas of tangency between the wire braided conductor 28 and an interior surface of the inner jacket 32. The axially and radially extending zone 30 of sealing composition also radially extends to and preferably bonds with an interior surface of the inner jacket 32 for filling in at least one area of tangency 31 between said braided conductor 28 and the interior of the inner jacket 32 wherein the sealing composition precludes the progression of fluid wicking past said radially and axially extending zone 30 of sealing composition. Thus, the axially and radially extending zone 30 of sealing composition may take the form of a substantially cylindrically shaped zone or band 30 of sealing composition which ensconces the braided conductor 28 along at least one axial length of the cable 10. Thus, an axial length of the braided conductor 28 and an axial length of tangency between the braided conductor 28 and both the dielectric 22 and the inner jacket 32 are essentially voidless as a result of the cylindrically shaped zone or band 30 of sealing composition disposed therein.

The inner jacket 32 is preferable an axially imperforate inner jacket 32 formed from an extruded fluorinated ethylene propylene (FEP) type of material. The extruded FEP inner jacket 32 includes an exterior surface which is preferably chemically etched with, for example, sodium naphthalene for providing an etched exterior surface 34 (please see FIG. 7) defining a bonding surface of the inner jacket 32.

Figure 8:
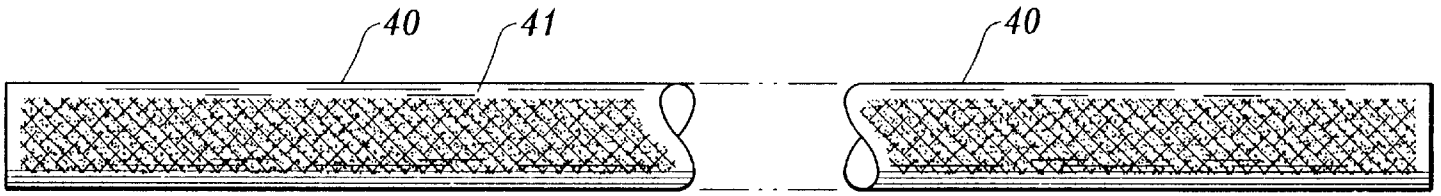
FIG. 8 is a perspective view of a braided sheath circumscribing the etched inner jacket shown in FIG. 7.

Referring to FIGS. 3 and 8, the ultimate strata 38 circumscribes the inner jacket 32 and includes at least one conductor 40 circumscribed by an outer jacket 44. The conductor 40 may be a flexible solid conductor, a stranded conductor or a combination of the two conductors which circumscribes the inner jacket 32. Preferably, conductor 40 is a stranded conductor and, in particular, a wire braided sheath or triax braid 40 which circumscribes the inner jacket 32. The braided sheath 40 is preferably formed from armored shield and preferably used to provide additional shielding and mechanical integrity to the cable 10. In addition, if the ultimate strata 38 becomes damaged, the braided sheath 40 prevents the braided conductor 28 from being shorted to ground by inadvertently contacting a grounded element such as a machine casing or conduit.

The braided sheath 40 is formed from a plurality of braided wire strands including interstices defined by spaces 41 interposed between the wire strands forming the braided sheath 40. In addition, a plurality of interstices are formed at the areas of tangency 39 and 43 between the braided sheath 40 and both the etched inner jacket 32 and the outer jacket 44.

Figure 9:
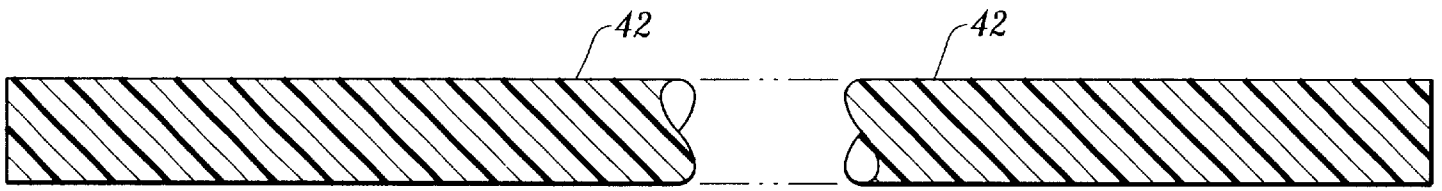
FIG. 9 is a perspective view of the braided sheath shown in FIG. 8 after being continuously impregnated with a sealing composition.

Referring to FIGS. 3 and 9, an axially and radially extending zone 42 of sealing composition is substantially continuously impregnated into the braided sheath 40 for filling in interstices preferably along an entire axial length of the braided sheath 40. The zone 42 of sealing composition radially extends to and bonds with the etched exterior surface 34 of the inner jacket 32 for filling in the interstices preferably along an entire axially extending area of tangency 39 between the inner jacket 32 and the braided sheath 40.

Referring to FIG. 3, the outer jacket 44 circumscribes the braided sheath 40 such that plurality of interstices are formed at the areas of tangency 43 between the braided sheath 40 and an interior surface of the outer jacket 44. The axially and radially extending zone 42 of sealing composition radially extends to the interior surface of the outer jacket 44 for filling in an entire axially extending areas of tangency 43 between the braided sheath 40 and the interior of the outer jacket 44 wherein the sealing composition precludes fluid wicking along the braided sheath 40. The axially and radially extending zone 42 of sealing composition may take the form of a substantially cylindrically shaped zone or band 42 of sealing composition which ensconces the braided sheath 40 thereby making the braided sheath 40 essentially voidless and for precluding fluid wicking along the entire axial length of the braided sheath 40.

The outer jacket 44 is preferable axially imperforate and formed from an extruded fluorinated ethylene propylene (FEP) type of material.

In one embodiment, the communication cable 10 is manufactured as one continuously long length (multiple meters) of cable which includes, inter alia, the braided conductor 28 intermittently impregnated with zones 30 of sealing composition or sealant along the axial length of the braided conductor 28 and which when cut to individual desired lengths includes a first axial length of the braided conductor which is ensconced with sealant and a second axial length adjacent the first axial length which is void of sealant such that the braided conductor 28 retains its original electrical connectivity along the second axial length. The process of manufacturing the cable is delineated in detail infra.

Referring to FIG. 4, the first step in manufacturing the communication cable 10 for precluding fluid wicking may be to provide the central signal transmission medium or central conductor 20 longitudinally extending from a first end 21 to a second end 23. Preferably, the central conductor 20 is formed from concentrically stranded high strength, high conductivity wire. Next, the dielectric 22 is extruded over the central conductor 20 and to ensconce the central conductor 20 from the first end 21 to the second end 23. Once the process of extruding the dielectric 22 over the central conductor 20 has been completed, the dielectric 22 is etched thereby forming the etched exterior surface 24 (please see FIG. 5). Preferably, the dielectric 22 is etched by running it through a chemical liquid etching bath comprising sodium naphthalene.

Referring to FIG. 6, the next step is to draw or wrap the braided conductor 28 over the etched exterior surface 24 of the dielectric 22. As mentioned above, the braided conductor 28 is formed from a plurality of braided strands having interstices defined by spaces 29 prevailing throughout. Furthermore, a plurality of interstices are disposed at the areas of tangency 27 (please see FIG. 3) between the braided conductor 28 and the dielectric 22.

Referring to FIG. 6, the next step is to form a plurality of zones 30 of sealing composition intermittently disposed along the axial length of the braided conductor 28 by advancing the cable as shown in FIG. 7 through a die and intermittently extruding uncured sealing composition through the die and under high pressure for forcing the uncured sealing composition through the braided wire strands of the braided conductor 28 and into contact with the etched exterior surface 24 of the dielectric 22. Thus, the intermittently extruded zones 30 of sealing composition fill in areas of tangency 27 between the dielectric 22 and the braided conductor 28 and also fill in the interstices 29 in the braided conductor 28 thereby ensconcing spaced apart axial lengths of the braided conductor 28 for essentially making the conductor 28 voidless at a plurality of intermittently spaced apart intervals.

The design/process feature of etching the exterior surface of the dielectric 22 and extruding the sealing composition in a liquid form and under high pressure to force the sealing composition into contact with the etched exterior surface 24 where it chemically bonds therewith. This is a very important design/process feature because without the etched exterior surface 24 and extrusion of the sealing composition under pressure there would be substantially no bonding between the extruded sealing composition and the dielectric thereby resulting in a leakage path at the areas of tangency 27 between the dielectric 22 and braided conductor 28.

Referring to FIGS. 6 and 7, the next step is to extrude the inner jacket 32 over the braided conductor 28 while the extruded sealing composition is still in a substantially uncured state so that the sealing composition will bond with the interior surface of the inner jacket 32. For example, once a zone or band 30 of sealing composition has been extruded it may be only about 10 feet away from having the inner jacket 32 extruded thereover. Note that the sealant is still in a liquid state (uncured) at the time that the inner jacket 32 is extruded in an uncured state thereon. Preferably, there is nothing touching the extruded sealant prior to the extrusion of the inner jacket 32, for example, the cable is suspended in air. Thus, the extruded sealant is not deformed or degraded in any way until the inner jacket 32 is disposed thereon. After the inner jacket 32 has been extruded over the braided conductor 28 the cable may be cured wherein the coaxial assembly 36 is formed.

Referring to FIG. 7, the inner jacket 32 is etched by preferably running it through a chemical liquid etching bath comprising sodium naphthalene wherein an etched exterior surface 34 of the inner jacket 32 is formed.

Next, and referring to FIG. 8, the braided sheath 40 is drawn or wound over the etched inner jacket 32. As mentioned above, the braided sheath 40 is formed from a plurality of braided strands having interstices 41 prevailing throughout. Furthermore, a plurality of interstices are disposed at the areas of tangency 39 between the braided sheath and the inner jacket.

Next, and referring to FIG. 9, the cable as shown in FIG. 8 is advanced through a die where the liquid sealant is extruded under high pressure over and through the braided sheath. The sealant is preferably extruded in a continuous fashion substantially along the entire axial length of the braided sheath 40 thereby filling in the interstices prevailing throughout and adjacent the braided sheath 40 for essentially making the braided sheath 40 and areas of tangency between the braided sheath 40 and inner jacket 32 essentially voidless. The sealing composition is extruded into contact with the inner jacket 32 where it chemically bonds to the etched exterior surface 34 of the inner jacket thereby forming a tight seal impervious to fluid wicking at the areas of tangency between the braided sheath 40 and inner jacket 32.

Next, and referring to FIG. 3, the outer jacket 44 is extruded over the braided sheath 40 thereby forming the communication cable 10. As a final step, the cable is uniformly cured. Preferably, the cable is manufactured in multiple meter lengths wherein as the process of forming the cable is completed the cable is preferably wound on a spool and placed in an oven for additional or final curing.

The design/process feature of alternating between an axial length of the braided conductor 28 which is ensconced with a zone 30 of sealing composition with an axial length which is substantially void of sealing composition fulfills the need for a cable which precludes fluid wicking while retaining its original ability to be readily electrically connectable to a transducer or sensor on at least one end. The spacing between the zones 30 is such that when a spool of cable is formed a user may cut a desired length which includes at least one zone or band 30 of sealant.

For example, each zone 30 of sealing composition may have an axial length of about 0.5 to 1.0 inches and is extruded through the braided conductor 28 in an intermittent fashion which is repeated, for example, approximately every 16.5 inches. Thus, when fluid migrates into the cable and it may be wicked up to an axial length of approximately 16.5 inches wherein at least one zone 30 of sealant abates the fluid from further wicking. A further important design/process feature behind the intermittent arrangement of the sealant zones or bands is to preclude the difficult endeavor of having to remove the sealant from the braided conductor every time the cable is prepared for attachment to the sensor. This difficult endeavor is the result of the fact that once the sealant is cured it is very difficult to be removed from the braided conductor and if not removed it precludes a proper conductivity point for transducer attachment.

The sealing composition or sealant impregnated into both the braided conductor 28 and braided sheath 40 is preferably a silicon composition being characterized by not out-gassing when in an uncured state, by being able to withstand high temperatures and by remaining substantially pliable when cured.

Figure 10:
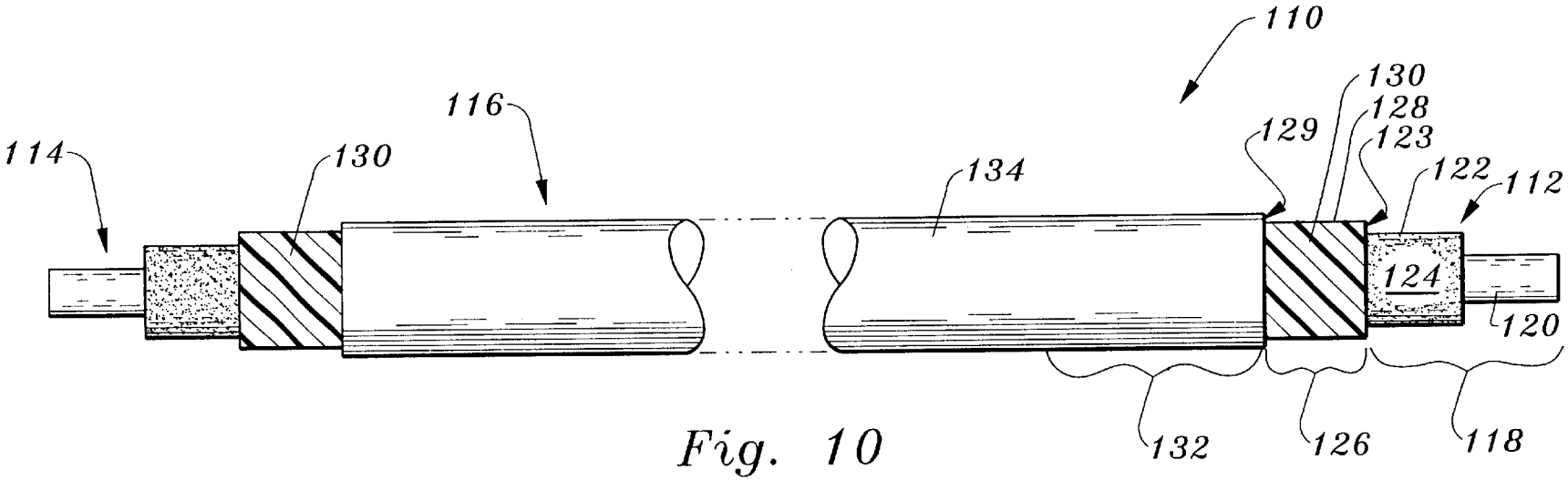
FIG. 10 is a perspective view of an alternative embodiment of the cable according to the instant invention.

According to an alternative embodiment and referring to FIG. 10, a coaxial communication cable 110 is provided which includes means for precluding wicking between a first end operatively coupled to a sensor or transducer and a second end operatively coupled to a processing or receiving unit which receives the signals engendered from the transducer or sensor. The coaxial communication cable 110 is comprised of a first end 112, a second end 114 and an intermediate portion 116 communicating the first end 112 with the second end 114. The intermediate portion 116 preferably includes a central strata 118, a penultimate strata 126 and ultimate strata 132 concentrically disposed. In addition, the coaxial communication cable 10 includes a substantially longitudinally extending continuous zone of sealing composition interposed between the concentric strata 118, 132 for filling in interstices defined by spaces within an and between the concentric strata 118, 132 for providing fluid wicking propensity within the interior of the coaxial cable 110.

More specifically, and referring to FIG. 10, the central strata 118 includes a central signal transmission medium 120 circumscribed by a central insulator or dielectric 122. The central signal transmission medium 120 includes at least one conductor or may include a plurality of conductors each of which may be formed from stranded wire, a solid conductor or a combination or the two. Preferably, the central signal transmission medium 120 is formed from a plurality of concentrically stranded high strength high conductivity wires. The dielectric 122 is preferably formed from a solid, extruded polytetrafluoroethylene (PTFE) type material.

The dielectric 122 includes an exterior surface 124 which is etched with, for example, sodium naphthalene for providing an etched exterior surface 124 defining a bonding surface of the dielectric 122.

The penultimate strata 126 circumscribes the dielectric 122 and includes at least one conductor 128 circumscribed by the ultimate strata 134. The conductor 128 may be a flexible solid conductor, a stranded conductor or a combination of these two types of conductors. Preferably, the conductor 128 is a stranded conductor and in particular, a wire braided conductor or a coax braid 128. The wire braided conductor 128 may, for example, be made from one of a class of materials characterized as having excellent conductivity, such as copper or copper clad steel with silver flash. Typically, the wire braided conductor 128 provides a ground connection which communicates the first end 112 with the second end 114.

The wire braided conductor 128 is formed from a plurality of braided wire strands including interstices defined by spaces 129 interposed between the wire strands forming the braided conductor 128. In addition, a plurality of interstices are formed at the areas of tangency 123 between the wire braided conductor 128 and the etched dielectric surface 124. The ultimate strata 132 circumscribing the braided conductor 128 includes an outer jacket 134. The outer jacket 134 is preferably axially imperforate and formed from an extruded fluorinated ethylene propylene (FEP) type of material.

In addition to the interstices formed between the area of tangency between the braided conductor 128 and the dielectric 122 there are similar interstices formed at the areas of tangency 129 the braided conductor 128 and the outer jacket 134.

The coaxial cable 110 further includes an axially and radially extending zone of sealing composition 130 which is substantially continuously impregnated into the braided conductor 128 for filling in the interstices substantially along the entire axial length of the braided conductor and substantially along an entire axially extending areas of tangency between the braided conductor 128 and both the dielectric 122 and the outer jacket 134.

In the alternative embodiment, the coaxial cable 110 is preferably manufactured as one continuously long length (multiple meters) of cable which includes, inter alia, the braided conductor 128 continuously impregnated with sealing composition substantially along the entire axial length of the braided conductor. The process of manufacturing the cable will now be delineated in detail.

The first step in manufacturing the coaxial communication cable 110 for precluding fluid wicking may be to provide the central signal transmission medium or central conductor 120 longitudinally extending from a first end to a second end. Next, the dielectric 122 is extruded over the central conductor 120 and ensconces the central conductor 120 from the first end to the second end. Once the process of extruding the dielectric over the central conductor has been completed, the dielectric is etched thereby forming the etched exterior surface 124. Preferably, the dielectric 122 is etched by running it through a chemical liquid etching bath comprising sodium naphthalene.

The next step is to draw or wrap the braided conductor 128 over the etched exterior surface 124 of the dielectric 122. Next, the cable is advanced through a die where the sealing composition or liquid sealant is extruded under high pressure over and through the braided conductor 128. The sealant is preferably extruded in a continuous fashion substantially along the entire axial length of the braided conductor 128 thereby filling in the interstices prevailing throughout and adjacent the braided conductor 128 for essentially making the braided conductor 128 and areas of tangency between the braided conductor and dielectric essentially voidless. The sealing composition is extruded under pressure such that it contacts the dielectric and chemically bonds with the etched exterior surface 124 of the dielectric thereby forming a tight seal impervious to fluid wicking along the braided conductor and leakage at the areas of tangency between the braided conductor 128 and the dielectric 122.

As a final step, the outer jacket 134 is preferably extruded over the braided conductor immediately after the sealing composition has been extruded over the braided conductor wherein the sealing composition is still in a substantially uncured state so that the sealing composition will bond with the interior surface of the outer jacket thereby filling in any interstices between the areas of tangency between the interior surface of the outer jacket and the braided conductor 128.

The sealing composition or sealant impregnated into the braided conductor 128 is preferably a silicon composition being characterized by not out-gassing when in an uncured state, by being able to withstand high temperatures and by remaining substantially pliable when cured.

In use and operation, and referring to FIGS. 1 and 2, upon completing the above delineated method of manufacturing the communication cable 10, a length of the communication cable 10 is cut from the spool of cable. Preferably, each length of cable cut from the spool of cable includes at least one radially and axially extending zone 30 of sealing composition impregnated into the braided conductor 28 wherein the sealing composition abates fluid progression via fluid wicking along the axial length of the braided conductor 28. In addition, each length of cable is preferably cut from the spool of cable such that the radially and axially extending zone of sealing composition is disposed within the braided conductor at a location distal from at least one end wherein an axial length of the braided conductor adjacent the one end is substantially void of sealant composition such that it may be readily electrically connected to a sensor element such as a coil 52 of the transducer 50.

It is important that at least one end of the cable 10 retains its original connectivity in order to procure a proper electrical connection between the coil 52 and the braided conductor 28 of the cable 10. For example, and referring to FIG. 2, the process of electrically connecting a pair of leads of the coil to respective conductors of the cable may proceed as follows. One end, for example end 12, of the cable 10 is stripped in a step like fashion to reveal a length of at least the central conductor 20 and the braided conductor 28. A preformed rear soldering ring may be inserted onto the stripped end of the cable 10 such that it encircles the braided conductor 28 and abuts against the inner jacket 32. A rear ferrule 56 is then inserted onto the stripped end of the cable 10 such that it encircles the braided conductor 28 and comes into engagement with the preformed rear soldering ring. A preformed front soldering ring or solder paste is then inserted onto the stripped end of the cable 10 such that it encircles the central conductor 20 and abuts against the dielectric 22. A front ferrule is then inserted onto the stripped end of the cable 10 such that it encircles the central 54 conductor 20 and comes into engagement with the preformed front soldering ring or solder paste. This cable assembly may be then positioned in an inductive heating unit where the soldering rings are melted and permeate into the adjacent areas between interior bores of the front end rear ferrules and the central and braided conductors 20, 28 respectively. When the preformed front and rear soldering rings have melted, a small amount of axial force may be applied to the front and rear ferrules so that a back end of each ferrule abuts against the dielectric 22 and the inner jacket 32 respectively. Once the solder is cooled, it locks the rear ferrule 56 to the braided conductor 28 and the front ferrule 54 to the central conductor 20 in a spaced coaxial proximity from one another.

Once a mechanical and electrical connection have been made between the front and rear ferrules and the respective conductors, the leads of the sensing coil 52 are resistance welded to the front and rear ferrules thereby providing a conductive connection between the coil and both the central conductor and the braided conductor. This assembly is then preferably ensconced in a encapsulation 51 thereby defining a housing for the transducer 50. The encapsulated transducer 50 is typically circumscribed by a threaded metal case 64.

Referring to FIG. 1, the status of the rotating shaft S of the machine 80 is monitored by the processing unit 100 via signals engendered from each encapsulated transducer 50 juxtaposed to the rotating shaft S via the threaded metal case 64 and a mounting means 84. Each communication cable 10 extends out of a back end 58 (see FIG. 2) of the transducer 50 and is routed through the machine case 82, preferably by way of an adapter 84 which includes an internal rubber grommet 86 which prevents leakage of fluid through the machine case 82 via the outside of the outer jacket 44.

After being routed through the machine case 82, each cable 10 preferably terminates to a connector 60 capable of directly coupling to the processing unit 100 or to an extension cable 102 which in turn couples to the processing unit 100. Preferably, a junction box 98 is mounted to the machine casing 82 and receives the connectors 60 of the communication cables 10 therein. The junction box 98 allows any electrical connections operatively coupling the communication cables 10 to the electrical processing unit 100 to be enclosed in a weather-proof and/or explosion-proof environment.

As a result of the harsh environmental conditions typically found within the machine 80, the outer jacket 44 can become cut or cracked thereby exposing the braided sheath 40 and in time the braided conductor 28. When fluid, for example oil, comes into contact with the braided conductor 28 and/or the braided sheath 40, it has heretofore been wicked up and transferred from one location to another via wicking and capillary attraction between the fluid and the braided conductor 28 and/or braided sheath 40. This causes the fluid to be transferred from an environment where it is safely contained to a location outside of the machine 80 where it causes a safety and environmental hazard. The instant invention precludes this. Furthermore, the encapsulation 51 of the transducer 50 may become cut or cracked and the oil may ingress into contact with the braided conductor 28 and/or the braided sheath 40 of the of the cable 10. Alternatively, the encapsulation of the transducer may be specifically designed to allow partial oil ingression. Heretofore, the oil would have been wicked up and transferred by the braided conductor and/or the braided sheath. Once again, this would have resulted in fluid being transferred from an environment where it is safely contained to a location outside of the machine where it would have caused a safety and an environmental hazard. The instant invention abates this.

Furthermore, the impregnated communication cable of the instant invention solves the problem of substantially retaining its original flexibility and also retaining its original connectivity of the conductors at a location being electrically connected to a sensing element.

Retaining the original flexibility and conductivity at an area proximate at least one end, for example, end 12 of the cable 10 is particularly important as a result of at least the one end 12 being required to be electrically coupled to sensing element, for example, coil 52. In addition, the end 12 of the cable 10 which is electrically coupled to the coil 52 may be required to make several very sharp angled bends when operatively coupled to the coil 52. In addition, the ability for the impregnated communication cable 10 to substantially retain its original flexibility allows the cable 10 to make an additional sharp bend at an area 58 where it exits a back end of a transducer 50 and also allows the cable to be easily routed through the machine case 82. Furthermore, the ability of the cable to substantially retain its original flexibility allows the cable 10 to make a sharp angle bend at an area where the cable 10 exits a back end of the connector 60.

Note that in the alternative embodiment the cable 110 does not utilize an axial length of the braided conductor 128 which is substantially void of sealant composition 130. Thus, the sealant composition 130 is preferably mechanically removed from the braided conductor 128 along at least one end by, for example, a wire brush means prior to the transducer 50 being coupled thereto.

Moreover, having thus described the invention, it should be apparent that numerous structural modifications and adaptations may be resorted to without departing from the scope and fair meaning of the instant invention as set forth hereinabove and as described hereinbelow by the claims.

We claim:

1. A communication cable, comprising in combination:

a first end and a second end;

a conductor communicating said first end with said second end;

a dielectric insulator circumscribing said conductor and including an exterior surface;

a braided conductor circumscribing said insulator, said braided conductor formed from a plurality of braided strands having interstices therebetween;

a plurality of impregnated axially spaced apart lengths of said braided conductor comprised of sealing composition filling said interstices of said braided conductor along said impregnated axially spaced apart lengths of said braided conductor for precluding fluid wicking along said impregnated axially spaced apart lengths of said braided conductor;

a non-impregnated axially extending length of said braided conductor interposed between two of said plurality of impregnated axially spaced apart lengths of said braided conductor that are consecutive;

said non-impregnated axially extending length of said braided conductor having interstices substantially devoid of said sealing composition such that a cut length of said cable formed by cutting between said two of said plurality of impregnated axially spaced apart lengths includes at least one of said plurality of impregnated axially spaced apart lengths for precluding fluid wicking and includes a cut end that falls on said non-impregnated axially extending length of said braided conductor having interstices adjacent said cut end substantially devoid of said sealing composition for providing an axial length of said braided conductor adjacent said cut end of said cable that retains its original electrical connectivity for electrically coupling to a transducer without having to remove sealing composition.

2. The communication cable of claim 1 further including an axially imperforate jacket circumscribing said braided conductor and including an interior surface.

3. The communication cable of claim 2 wherein said sealing composition filling said interstices of said braided conductor along said impregnated axially spaced apart lengths of said braided conductor radially extends into at least one area of tangency between said dielectric insulator and said braided conductor and into at least one area of tangency between said braided conductor and said axially imperforate jacket for precluding the progression of fluid wicking past each of said plurality of impregnated axially spaced apart lengths of said braided conductor.

4. The communication cable of claim 3 wherein said dielectric insulator includes a pre-etched exterior surface for enhancing the bonding between said dielectric and each of said plurality of impregnated axially spaced apart lengths of said braided conductor.

5. The communication cable of claim 4 wherein said axially imperforate jacket is extruded over said braided conductor while said sealing composition and said axially imperforate jacket are both in a fluidic state for enhancing the bonding between said interior surface of said axially imperforate jacket and each of said plurality of impregnated axially spaced apart lengths of said braided conductor.

6. The communication cable of claim 5 further including a sheath circumscribing said axially imperforate jacket and including a plurality of braided strands having interstices therebetween.

7. The communication cable of claim 6 further including an axially elongated zone of sealing composition impregnated into said braided sheath and filling said interstices of said sheath along an entire length.

8. The communication cable of claim 7 further including an axially imperforate outer jacket circumscribing said braided sheath.

9. communication cable of claim 8 wherein said axially elongated zone of sealing composition radially extends into at least one area of tangency between said axially imperforate jacket and said braided sheath and into at least one area of tangency between said braided sheath and said axially imperforate outer jacket wherein said sealing composition precludes fluid wicking along said braided sheath.

10. The communication cable of claim 9 wherein said axially imperforate jacket includes a pre-etched exterior surface for enhancing the bonding between said axially imperforate jacket and said axially elongated zone of sealing composition which fills in at least the one said area of tangency between said axially imperforate jacket and said braided sheath.

11. A communication cable, comprising in combination:

a central strata;

a penultimate strata circumscribing said central strata;

an ultimate strata circumscribing said penultimate strata;

a plurality of spaced apart axially extending first zones of sealing composition intermittently impregnated within said penultimate strata and intermittently extending along an axial length of said penultimate strata for abating fluid progression via fluid wicking within said penultimate strata;

at least one axially extending second zone of said penultimate strata substantially devoid of said sealing composition and interposed between two of said plurality of spaced apart axially extending first zones of sealing composition that are consecutive;

an axially extending third zone of sealing composition impregnated within said ultimate strata for precluding fluid wicking within said ultimate strata;

said axially extending third zone of sealing composition radially spaced from and concentric with both said plurality of spaced apart axially extending first zones and said at least one axially extending second zone of said penultimate strata.

12. The communication cable of claim 11 wherein said central strata is comprised of a central signal transmission medium circumscribed by a dielectric including an etched exterior surface.

13. The communication cable of claim 12 wherein said penultimate strata is comprised of a braided conductor and an axially imperforate inner jacket, said braided conductor circumscribing said dielectric and said inner jacket circumscribing said braided conductor and including an etched exterior surface.

14. The communication cable of claim 13 wherein each of said plurality of spaced apart axially extending first zones of sealing composition radially extends into and bonds with the etched exterior surface of said dielectric for filling in at least one axially extending area of tangency between said dielectric and said braided conductor and, wherein each of said plurality of spaced apart axially extending first zones of sealing composition radially extends into and bonds with an interior surface of said inner jacket for filling in at least one axially extending area of tangency between said braided conductor and said axially imperforate inner jacket wherein said sealing composition precludes the progression of fluid wicking past said radially and axially extending zones of sealing composition.

15. The communication cable of claim 14 wherein said ultimate strata is comprised of a braided sheath and a outer jacket, said braided sheath circumscribing said axially imperforate inner jacket and said outer jacket circumscribing said braided sheath.

16. The communication cable of claim 15 wherein said second zone of sealing composition is continuously impregnated along the entire axial length of said braided sheath and radially extends into and bonds with the etched exterior surface of said inner jacket for filling in an axially extending area of tangency between said inner jacket and said braided sheath and, wherein said axially extending second zone of sealing composition radially extends into and bonds with an interior surface of said inner jacket for filling in an axially extending area of tangency between said braided conductor and said axially imperforate outer jacket wherein said sealing composition precludes fluid wicking and capillary attraction of fluid along said braided sheath.

17. A communication cable, comprising in combination:

a central strata and a penultimate strata concentrically disposed;

a series of sequentially alternating axially extending zones interposed between said concentrically disposed strata and comprised of:

a plurality of impregnated zones of sealing composition filing interstices interposed between said concentrically disposed strata along each of said plurality of impregnated zones, and a plurality of non-impregnated zones having interstices interposed between said concentrically disposed strata substantially devoid of sealing composition along each of said plurality of said non-impregnated zones such that said series of axially extending zones sequentially alternate between one of said plurality of impregnated zones and one of said plurality non-impregnated zones, and such that said series of axially extending zones sequentially alternate between precluding fluid wicking along each of said plurality of impregnated zones and retaining original electrical connectivity along each of said plurality of non-impregnated zones.

18. The communication cable of claim 17 further including a ultimate strata circumscribing said penultimate strata and further including a substantially continuous band of sealing composition interposed between said penultimate strata and said ultimate strata for filling in interstices therebetween thereby precluding fluid wicking propensity between said penultimate strata and said ultimate strata.

19. The communication cable of claim 17 wherein said sealing composition is characterized by remaining substantially pliable when uniformly cured.

20. A communication cable, comprising in combination:

a dielectric circumscribing a central conductor;

a braided conductor circumscribing said dielectric, said braided conductor formed from a plurality of braided strands having interstices therebetween;

a series of sequentially alternating axially extending zones of said braided conductor comprised of:

a plurality of spaced apart axially extending impregnated zones of sealing composition filing said interstices of said braided conductor and intermittently extending along an axial length of said braided conductor, and a plurality of spaced apart axially extending non-impregnated zones having said interstices of said braided conductor substantially devoid of sealing composition and intermittently extending along said axial length of said braided conductor such that said series of sequentially alternating axially extending zones of said braided conductor sequentially alternate between one of said plurality of impregnated zones and one of said plurality non-impregnated zones, and such that said series of sequentially alternating axially extending zones sequentially alternate between precluding fluid wicking along each of said plurality of impregnated zones and retaining original electrical connectivity along each of said plurality of non-impregnated zones.

* * * * *